US005629138A

United States Patent [19]

Faranda et al.

[11] Patent Number: 5,629,138

[45] Date of Patent: May 13, 1997

[54] PHOTOGRAPHIC FIXER COMPOSITION AND METHOD

[75] Inventors: Filippo Faranda, Savona; Elda Moizo, Carcare; Carlo Marchesano, Savona, all of Italy

[73] Assignee: Imation Corp, Saint Paul, Minn.

[21] Appl. No.: 581,450

[22] Filed: Dec. 29, 1995

[30] Foreign Application Priority Data

Feb. 10, 1995 [EP] European Pat. Off. ..... 95101822

[51] Int. Cl.[6] ..... G03C 5/38

[52] U.S. Cl. ..... 430/455; 430/453; 430/459

[58] Field of Search ..... 430/453, 455, 430/458, 459

[56] References Cited

U.S. PATENT DOCUMENTS

| | | | |
|---|---|---|---|
| 5,298,382 | 3/1994 | Toyoda et al. | 430/539 |
| 5,401,621 | 3/1995 | Kojima et al. | 430/455 |

FOREIGN PATENT DOCUMENTS

| | | |
|---|---|---|
| 0538947A1 | 4/1993 | European Pat. Off. . |
| 0550933A1 | 7/1993 | European Pat. Off. . |
| 0620483A1 | 10/1994 | European Pat. Off. . |
| J04019739A | 1/1992 | Japan . |
| 05127323A | 5/1993 | Japan . |

OTHER PUBLICATIONS

"Reducing the Evolution of Sulphur Dioxide from Photographic Fixing Baths," Research Disclosure, Feb., 1977, p. 5, No. 15407.

*Primary Examiner*—Hoa Van Le

*Attorney, Agent, or Firm*—Mark A. Litman; Gregory A. Evearitt; Arlene K. Musser

[57] ABSTRACT

The present invention provides a fixer composition and a method of processing an exposed photographic silver halide element comprising the steps of developing by means of a developer comprising a silver halide developing agent and treating the developed element with a fixer composition, wherein the fixer composition comprises a silver halide solvent, a sulfite ion source, an aluminum salt hardening agent, a buffering agent, a sequestering agent and an α-ketocarboxylic acid compound in an amount of more than 2 grams per liter corresponding to the formula:

R—CO—COOH wherein R represents a hydrogen atom or an organic group.

19 Claims, No Drawings

PHOTOGRAPHIC FIXER COMPOSITION AND METHOD

FIELD OF THE INVENTION

The present invention relates to photographic fixer compositions, and, in particular, to photographic fixer compositions having reduced sulfur dioxide emissions.

BACKGROUND OF THE ART

In processing photographic films, especially black and white films, it is highly advantageous to complete the processing in a very short period of time. To accomplish this objective, it is common practice to process such films using a roller transport processor and to carry out the processing without an intervening washing step between the steps of developing and fixing. This method of processing is described, for example, in U.S. Pat. No. 3,545,971. To facilitate the use of a roller transport processor, both the developer and the fixer typically contain a hardening agent, with the hardening agent usually being an aldehyde in the developer and an aluminum salt in the fixer. Boric acid is often incorporated in the fixer used in the aforesaid process to prevent the formation of sludge resulting from precipitation of aluminum hydroxide when the fixer is contaminated by developer carry-in. Such use of boric acid is describe, for example, in U.S. Pat. No. 4,046,570.

To further promote the objective of a very short total processing time, it is advantageous to employ ammonium thiosulfate as the fixing agent, because it acts more rapidly than alternative fixing agents such as sodium thiosulfate, as described in GB 1,290,026. Additionally, the fixer contains a sulfite salt to stabilize the thiosulfate against decomposition with respect to time and temperature. Thus, a particularly desirable fixer is one which contains ammonium thiosulfate and a sulfite salt. The pH of these fixer baths is normally around 4.00–4.30, because at higher pH, especially more than 5.00, there is precipitation of $Al(OH)_3$. On the other hand, lower pH is correlated with high sulfur dioxide evolution, which is environmentally dangerous. Different solutions to the problem of reducing the sulfur dioxide evolution have been disclosed in the art.

Research Disclosure No. 15407, February 1977, discloses a method for reducing the evolution of sulfur dioxide from photographic fixing baths by adding a suitable quantity of a sulfite-complexing agent when preparing the working strength solution. This enables the sulfite concentration in the fixer concentrate to remain at the accepted high level required to stabilize the thiosulfate, but, upon dilution, the complexing agent will reduce the sulfate content to a sufficiently low level, that the evolution of sulfur dioxide is minimized. The sulfite-complexing agent may be an aldehyde, e.g., glutaraldehyde, ketone, e.g., acetone, or any compound which forms a relatively stable sulfite complex in aqueous solution in the pH range from 3 to 6.

Japanese Patent Application No. 05-119,445 describes a fixer for photographic materials containing specified amounts of ammonium thiosulfate and of sodium thiosulfate which do not generate toxic gases during processing.

Japanese Patent Application No. 04-019,739 describes a solid fixer for silver halide photographic material containing thiosulfate and sulfite and at least one of citric, tartaric, malic, succinic and phenyl acetic acids to prevent sulfur dioxide gas generation.

U.S. Pat. No. 5,298,382 describes a fixer concentrate containing a thiosulfate as a fixing agent, sulfite and water-soluble aluminum salt; the concentrated fixer is then diluted with water, thereby forming the working fixer solution containing a minimized amount of ammonium thiosulfate and of sodium thiosulfate, preventing the generation of sulfurous acid and ammonia gases.

In some cases the bad odors caused by the sulfur dioxide evolution has been reduced by adding specific compounds to the fixer, without reducing the sulfur dioxide evolution itself. In fact, Japanese Patent Application No. 05-313,320 describes a fixing liquid containing thiosulfate in concentrated state and diluted at time of use to prevent bad odors from being given off. In addition, a fixer composition comprising fixing agents, stabilizer, hardening agents and acids, e.g., succinic or maleic acid, has been disclosed in Japanese Patent Application No. 05-127,323.

European Patent Application 620,483 describes a method of image formation to reduce visible appearing disturbed lines observed at the surface of processed films. The method includes treating a silver halide material with a developer comprising at least one anionic alkylphenoxy polyalkyleneoxy phosphate ester surfactant and a fixer which may comprise at least one alpha-ketocarboxylic acid in an amount from 1 to 2 grams per liter, the material containing at least one polyoxyalkylene compound as a surfactant, a hardening agent different from vinyl sulphone and at least a non-sensitive protective antistress coating. The alpha-ketocarboxylic acid compounds therein disclosed are oxalic acid, glyoxilic acid and pyruvic acid compounds.

It could be useful to have a photographic fixer composition showing a reduced sulfur dioxide emission.

SUMMARY OF THE INVENTION

A photographic fixer composition is described in the present invention, said composition comprising a silver halide solvent, a sulfite ion source, an aluminum salt hardening agent, a sequestering agent and an α-ketocarboxylic acid compound in an amount of more than 2 grams per liter.

The present invention also provides a method of processing an exposed photographic silver halide element comprising the steps of developing by means of a developer comprising a silver halide developing agent and treating the developed element with a fixer composition, wherein the fixer composition is as described above.

The photographic fixer composition of the present inventions shows a reduced sulfur dioxide emission.

DETAILED DESCRIPTION OF THE INVENTION

The α-ketocarboxylic acid contained in the photographic fixer composition of the present invention is represented by the following formula (I):

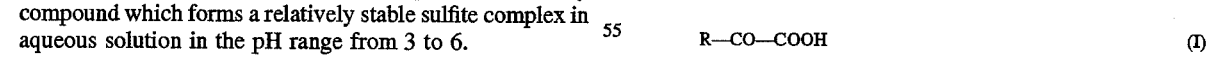

$$R—CO—COOH \quad (I)$$

wherein R represents a hydrogen atom or an organic group.

Organic groups useful in the above formula are well known in the photographic art and can be selected upon the basis of various common criteria. For example, they should be reasonable in size and nature. R should be useful to the properties of the α-ketocarboxylic acid compounds, such as to control their solubility in the photographic fixer composition. In the compounds represented by the formula (I) above, R particularly represents a COOH group or an aliphatic group, an aromatic group or a heterocyclic group, each of these R groups preferably having a number of carbon atoms not higher than 12. The aliphatic group includes straight and branched chain alkyl groups, cycloalkyl groups, alkenyl groups and alkynyl groups. Said straight or branched chain aliphatic groups (comprising alkyl, alkenyl and alkynyl groups) preferably contain 1 to 8 carbon atoms (e.g., methyl, ethyl, propyl, allyl, butyl, amyl, hexyl, octyl), and more preferably contain 1 to 4 carbon atoms. The cycloalkyl groups preferably contain 3 to 10 carbon atoms; preferred examples thereof include cyclopropyl, cyclopentyl, cyclohexyl and adamantyl groups. The aromatic groups preferably contain 6 to 10 ring carbon atoms (e.g., phenyl, naphthyl). Typical examples of α-ketocarboxylic acid compounds according to the present invention include HOC—COOH (glyoxylic acid), HOOC—CO—COOH (mesoxalic acid), $CH_3$—CO—COOH (pyruvic acid), HOOC—CO—$CH_2$—CO—COOH (oxalacetic acid), $C_2H_5$—CO—COOH (2-ketobutyric acid), HOOC—$CH_2$—$CH_2$—CO—COOH (2-ketoglutaric acid), $C_6H_5$—$CH_2$—CO—COOH (phenylpyruvic acid) and

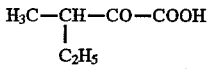

(α-keto-β-methylvaleric acid).

When the term "group" or "nucleus" is used in the present invention, the described chemical material includes the basic group or nucleus and that group or nucleus with conventional substituents. When the term "moiety" is used to describe a chemical compound or substituent, only an unsubstituted chemical material is intended to be included. For example, "alkyl group" includes not only such alkyl moieties as methyl, ethyl, octyl, stearyl, etc. but also such moieties bearing substituent groups such as halogen, cyano, hydroxyl, nitro, amine, carboxylate, etc. On the other hand, "alkyl moiety" or "alkyl" includes only methyl, ethyl, octyl, stearyl, cyclohexyl, etc.

The amount of α-ketocarboxylic acid compounds is generally in the range of more than 2 to about 50 grams per liter, preferably from more than 2 to 20 grams per liter in the fixer solution during use.

α-Ketocarboxylic acid compounds may be advantageously obtained by oxidation under mild conditions of α-hydroxy acids or methyl ketone. These and other methods to obtain α-ketocarboxylic acid compounds are described, for example, by V.Migrdichian, Organic Synthesis, Reinhold Publ., 1956, page 267.

The photographic fixer composition of the present invention comprises as silver halide solvent a thiosulfate or thiocyanate, thiosulfate being preferred, e.g. ammonium thiosulfate, sodium thiosulfate, potassium thiosulfate and the like, as described in U.S. Pat. No. 3,582,322. The amount of silver halide solvent in the fixer solution is generally in the range from about 0.5 to about 2.5 mol per liter.

For increasing the shelf stability of the fixer composition, the fixer comprises a source of sulfite ions, such as sulfite or bisulfite salt compounds. For example, sodium or potassium sulfite, sodium or potassium bisulfite, sodium or potassium metabisulfite can be used. The concentration of this source of sulfite ions is at least 0.1 mol per liter.

The aluminum salt hardening agent contained in the photographic fixer composition of the present invention is of the kind generally used in acid hardening fixers which include soluble aluminum salts or complexes like aluminum chloride, aluminum sulfate and potassium or ammonium alum. The amount of aluminum salt hardening agent is dependent on the desired hardening effect which depends on the particular photographic element to be processed and prehardening stages, e.g., possible development by means of a developing solution containing hardening agents, e.g., dialdehyde hardeners as represented by glutaraldehyde or its bisulfite addition product. Generally the amount of aluminum salt hardening agent is at least 0.01 mol per liter, and preferably between about 0.02 mol and about 0.2 mol per liter in the fixer.

Useful sequestering agents present in the photographic fixer composition of the present invention are aminopolycarboxylic acid compounds (e.g. nitrilotriacetic acid (NTA), ethylenediaminotetracetic acid (EDTA), diethylenetriaminopentacetic acid (DTPA), diaminopropanoltetracetic acid (DPTA) and ethylenediamino-N,N,N',N'-tetrapropionic acid (EDTP)), polyphosphonic acid compounds (e.g., dialkylaminomethane diphosphonic acid), and the like. The amounts of the sequestering agent depend on the amount of the aluminum salt hardening agent present in the fixer composition of the present invention. In practice, at least 0.05 mol, preferably at least 0.10 mol, of sequestering agent are needed per 10 moles of aluminum salt hardening agent.

Buffering agents are included in the photographic fixer composition of the present invention, for example, sodium acetate, sodium citrate and ammonium acetate. The amount of ammonium ions contained in the fixer composition is at least about 0.20 mol/l, preferably at least 0.30 mol/l.

The fixer composition may further comprise the usual ingredients, e.g., inorganic or organic acids to obtain the required acidity which is generally in the range from about 3.50 to about 7.00, preferably from about 4.20 to about 6.00, e.g., sulfuric acid, acetic acid and citric acid, a borate (e.g. borax), wetting agents, and the like.

The fixer composition of the present invention can be usually made as ready-to-use composition or as single concentrated liquid part that is then diluted with water in automatic processors by the use of a mixer, to have a ready-to-use solution. A method of making a concentrated photographic composition packaged in a single concentrated part to be diluted with water to form a ready-to-use solution is shown, for example, in U.S. Pat. No. 4,987,060.

In another aspect, the present invention refers to a process for treating an exposed photographic silver halide element comprising the steps of developing by means of an aqueous alkaline developing solution comprising a silver halide developing agent and treating the developed element with a fixer composition of the present invention.

The developing agents employed in the aqueous alkaline developing solution for use in the practice of this invention are well-known and widely used in photographic processings. Useful developing agents are chosen among the class of ascorbic acid, reductic acid and dihydroxybenzene compounds. Among the dihydroxybenzene compounds, the preferred developing agent is hydroquinone. Other useful dihydroxybenzene developing agents include chlorohydroquinone, bromohydroquinone, isopropylhydroquinone, tolylhydroquinone, methylhydroquinone, 2,3-dichlorohydroquinone, 2,5-dimethylhydroquinone, 2,3-dibromohydroquinone, 1,4-dihydroxy-2-acetophenone-2,5-dimethylhydroquinone, 2,5-diethylhydroquinone, 2,5-di-p-phenethylhydroquinone, 2,5-dibenzoylhydroquinone, 2,5-diacetaminohydroquinone.

The aqueous alkaline developing solution for use in the practice of this invention also comprises auxiliary developing agents showing a superadditive effect, as described in Mason, "Photographic Processing Chemistry", Focal Press, London, 1975.

For the purpose of the present invention, the preferred superadditive auxiliary developing agents are those described in U.S. Pat. No. 5,236,816; particularly useful are the auxiliary developing agents such as aminophenol and substituted aminophenol (e.g., N-methyl-p-aminophenol, also known as metol and 2,4-diaminophenol) and pyrazolidones (e.g., 1-phenyl-3-pyrazolidone, also known as phenidone) and substituted pyrazolidones (e.g., 1-phenyl-4-methyl-3-pyrazolidone, 1-phenyl-4-methyl-4-hydroxymethyl-3-pyrazolidone, also known as dimezone S, and 1-phenyl-4,4'-dimethyl-3-pyrazolidone, also known as dimezone).

The aqueous alkaline photographic developing solution for use in the practice of this invention contains a sulfite preservative at a level sufficient to protect the developing agents against the aerial oxidation and thereby assure good stability characteristics. Useful sulfite preservatives include sulfites, bisulfites, metabisulfites and carbonyl bisulfite adducts. Typical examples of sulfite preservatives include sodium sulfite, potassium sulfite, lithium sulfite, ammonium sulfite, sodium bisulfite, potassium metabisulfite, sodium formaldehyde bisulfite salt. Also ascorbic acid is a known preservative agent against aerial oxidation of the developer for use in the bath.

Typically, the dihydroxybenzene developing agent is used in an amount of from 0.040 to 0.70 moles per liter, more preferably in an amount of from 0.08 to about 0.40 moles per liter; the 3-pyrazolidone developing agent is used in an amount of from 0.001 to 0.05 moles per liter, more preferably in an amount of from 0.005 to 0.01 moles per liter; the sulfite preservative is used in an amount of from 0.03 to 1.0 moles per liter, more preferably in an amount of from 0.10 to 0.70 moles per liter.

In carrying out the method of this invention, it is preferred to use an organic antifogging agent to minimize fog formation in the processed element. Preferred organic antifogging agents for specific use in the developing solutions are benzotriazole and/or a benzimidazole antifogging agents, which proved to have beneficial effects on increasing contrast. Useful quantities, when they are included in the emulsion, may vary from 1 to 100 milligrams per 100 grams of emulsion and, when included in the developing bath, as preferred, may vary from 0.01 to 5 grams per liter.

In addition to the essential components specified hereinabove, the developing solutions can optionally contain any of a wide variety of addenda useful in photographic developing solutions. For example, they can contain solvents, buffers, sequestering agents, development accelerators, agents to reduce swelling of the emulsion layers, and the like.

The fixing compositions of the present invention are useful in a process for treating a silver halide photographic element which can be used for any general black and white photography, graphic arts, X-ray, print, microfilm, color reversal (i.e., in the black and white development step of a color reversal process), and the like, as described, for example, in EP patent applications 632,323; 622,670; 618,490; 595,089; 591,747 and 581,065.

The following examples illustrates the present invention.

In the examples, percentages are by weight and solutions are water solutions, unless otherwise stated.

EXAMPLE 1

Ready-to-use fixer composition (Sample 1) was prepared having the following composition:

| | | |
|---|---|---|
| Water up to | l | 1 |
| Ammonium thiosulfate | g | 145.2 |
| Sodium Sulfite | g | 8.125 |
| Boric Acid | g | 7 |
| Ammonium Acetate | g | 19.24 |
| EDTA | g | 1.5 |
| Compound A (*) | g | 1.5 |
| Acetic Acid | g | 22.5 |
| Aluminium Sulfate | g | 8.9 |
| Ammonium 25% sol. | g | 17.0 |
| pH | | 4.80 |

(*) Compound A is Budex ™ 5103 compound, produced by Budenheim Co. and having the following formula:

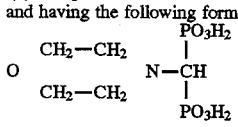

Sample 2 was prepared as Sample 1, with the addition of 1.25 g of glyoxylic acid. KOH 35% was then added to obtain a pH of 4.80 as Sample 1.

Sample 3 was prepared as Sample 1, with the addition of 2.5 g of glyoxylic acid. KOH 35% was then added to obtain a pH of 4.80 as Sample 1.

Sample 4 was prepared as Sample 1, with the addition of 3.75 g of glyoxylic acid. KOH 35% was then added to obtain a pH of 4.80 as Sample 1.

Sample 5 was prepared as Sample 1, with the addition of 1.25 g of pyruvic acid. KOH 35% was then added to obtain a pH of 4.80 as Sample 1.

Sample 6 was prepared as Sample 1, with the addition of 2.5 g of pyruvic acid. KOH 35% was then added to obtain a pH of 4.80 as Sample 1.

Sample 7 was prepared as Sample 1, with the addition of 5 g of pyruvic acid. KOH 35% was then added to obtain a pH of 4.80 as Sample 1.

The sulfur dioxide emission from Samples 1–7 was analytically evaluated, following the method described in "Supplemento ordinario alia Gazzetta Ufficiale Iraliana" No. 59, Mar. 8, 1971. The method consisted in conveying fumes coming from the fixer solutions into a solution containing $H_2O_2$ and then analyzing the concentration of $SO_3$ (as $H_2SO_4$) in the solution by an acid-base tritation. Then, the content of sulfur dioxide in fumes was easily determined. The results, showed in Table 1, are expressed as percentage in volume and then converted in parts per million.

TABLE 1

| Samples | Compound of Formula (I) | (g) | $SO_2$ Evolution p.p.m. |
|---|---|---|---|
| 1 (ref.) | / | 0 | 30.5 |
| 2 (ref.) | Glyoxylic Acid | 1.25 | 16.0 |
| 3 (inv.) | Glyoxylic Acid | 2.5 | 12.1 |
| 4 (inv.) | Glyoxylic Acid | 3.75 | 9.2 |
| 5 (ref.) | Pyruvic Acid | 1.25 | 15.1 |
| 6 (inv.) | Pyruvic Acid | 2.5 | 7.6 |
| 7 (inv.) | Pyruvic Acid | 5.0 | 4.6 |

Table 1 shows a large decreasing in the evolution values of sulfur dioxide coming from fixing baths containing compounds of formula (I) of the present invention in an amount of more than 2 grams per liter (Samples 3, 4, 6 and 7) compared with fixing baths containing lower amounts of such compounds (Samples 2 and 5).

EXAMPLE 2

Sample 8 was prepared as Sample 1 with the addition of 2 g of acetone, as described in Research Disclosure 15,407.

Sample 9 was prepared as Sample 1 with the addition of 5.0 g of succinic acid, as described in Japanese Patent Applications Nos. 05-127,323 and 04-019,739.

The sulfur dioxide evolution in fresh Samples 1, 3, 8 and 9 was measured by putting 100 ml of the samples in a 150 ml container covered by a filter paper imbibed with iodine. The evolution of sulfur dioxide caused a decoloration of the filter paper. The higher is the sulfur dioxide evolution, the lower is the decoloration time. The same experiments were repeated for the same samples after incubation for 2 hours at 35° C. Table 2 shows the results; the decoloration time is expressed in minutes.

TABLE 2

| Samples | | (g) | Decoloration time (minutes) Fresh | After 2 h 35° C. |
|---|---|---|---|---|
| 1 (ref.) | — | 0 | 30 | 18 |
| 3 (inv.) | Glyoxylic Acid | 2.5 | 90 | 65 |
| 8 (ref.) | Acetone | 2 | 50 | 18 |
| 9 (ref.) | Succinic Acid | 5 | 37 | 16 |

Table 2 shows that the addition of acetone to fixing bath solutions (Sample 8), as described in Research Disclosure 15,407, has a little advantage in the reduction of the sulfur dioxide evolution of fresh solutions, but it is not useful for fixing solutions kept in incubation. Sample 9, containing succinic acid as described in Japanese Patent Applications Nos. 05-127,323 and 04-019,739, is not useful to reduce the sulfur dioxide evolution. On the contrary, the fixing solution of the present invention (Sample 3) shows a reduced sulfur dioxide evolution also after incubation.

EXAMPLE 3

Sample 10, 11 and 12 were prepared as Sample 1 with the addition of, respectively, 1.0, 1.4 and 2.5 grams of oxalic acid, as described in European Patent Application 620,483.

Sample 13 and 14 were prepared as Sample 1 with the addition of, respectively, 1.0 and 1.4 grams of glyoxylic acid.

The sulfur dioxide evolution of Samples 1, 3, 10–14 was measured as in Example 2. The higher is the sulfur dioxide evolution, the lower is the decoloration time. Table 3 shows the results; the decoloration time is expressed in minutes.

TABLE 3

| Samples | Compound of Formula (I) | (g) | Decoloration time (minutes) |
|---|---|---|---|
| 1 (ref.) | / | 0 | 30 |
| 10 (ref.) | Oxalic Acid | 1.0 | 32 |
| 11 (ref.) | Oxalic Acid | 1.4 | 42 |
| 12 (ref.) | Oxalic Acid | 2.5 | 54 |
| 13 (ref.) | Glyoxylic Acid | 1.0 | 55 |
| 14 (ref.) | Glyoxylic Acid | 1.4 | 73 |
| 3 (inv.) | Glyoxylic Acid | 2.5 | 90 |

Table 3 shows that the addition of oxalic acid to fixing bath solutions (Samples 10,11,12), as described in European Patent Application 620,483, is not useful to reduce the sulfur dioxide evolution.

We claim:

1. Photographic fixer compositions comprising a silver halide solvent, a sulfite ion source, an aluminum salt hardening agent, a sequestering agent and an α-ketocarboxylic acid compound in an amount from 2.5 grams per liter.

2. Photographic fixer compositions of claim 1, wherein the α-ketocarboxylic acid compound corresponds to the formula:

R—CO—COOH wherein R represents a hydrogen atom or an organic group.

3. Photographic fixer compositions of claim 1, wherein said α-ketocarboxylic acid compound is HOOC—CO—COOH, $H_3C$—CO—COOH, or H—CO—COOH.

4. Photographic fixer compositions of claim 1, wherein the amount of said α-ketocarboxylic acid compounds is in the range from more than 2 to about 20 grams per liter.

5. Photographic fixer compositions of claim 4, wherein the silver halide solvent is ammonium thiosulfate, sodium thiosulfate or potassium thiosulfate.

6. Photographic fixer compositions of claim 1, wherein the amount of said silver halide solvent is in the range of from about 0.5 to about 2.5 mol per liter.

7. Photographic fixer compositions of claim 1, wherein the sulfite ion source is a sulfite, bisulfite or metabisulfite salt compound.

8. Photographic fixer compositions of claim 1, wherein the sulfite ion source is in an amount of at least 0.1 mol per liter.

9. Photographic fixer compositions of claim 1, having a pH in the range from 3.50 to 7.00.

10. The photographic fixer composition of claim 1 wherein said α-ketocarboxylic acid is present in an amount of from 2.5 to 10 grams per liter.

11. The photographic fixer composition of claim 2 wherein said α-ketocarboxylic acid is present in an amount of from 2.5 to 10 grams per liter.

12. The photographic fixer composition of claim 3 wherein said α-ketocarboxylic acid is present in an amount of from 2.5 to 10 grams per liter.

13. The photographic fixer composition of claim 4 wherein said α-ketocarboxylic acid is present in an amount of from 2.5 to 10 grams per liter.

14. The photographic fixer composition of claim 5 wherein said α-ketocarboxylic acid is present in an amount of from 2.5 to 10 grams per liter.

15. The photographic fixer composition of claim 6 wherein said α-ketocarboxylic acid is present in an amount of from 2.5 to 10 grams per liter.

16. The photographic fixer composition of claim 7 wherein said α-ketocarboxylic acid is present in an amount of from 2.5 to 10 grams per liter.

17. The photographic fixer composition of claim 8 wherein said α-ketocarboxylic acid is present in an amount of from 2.5 to 10 grams per liter.

18. The photographic fixer composition of claim 9 wherein said α-ketocarboxylic acid is present in an amount of from 2.5 to 10 grams per liter.

19. Process for treating an exposed photographic silver halide element comprising the steps of developing by means of a developer comprising a silver halide developing agent and treating the developed element with a fixer composition, wherein the fixer composition is as in claim 1.

* * * * *